United States Patent [19]

Jennings

[11] Patent Number: 4,892,318

[45] Date of Patent: Jan. 9, 1990

[54] GOLF BALL STORAGE, DISPENSING AND TEEING APPARATUS

[76] Inventor: Kenneth L. Jennings, Rte. 2, Box 83-4, Strafford, Mo. 65757

[21] Appl. No.: 223,433

[22] Filed: Jul. 25, 1988

[51] Int. Cl.[4] ..... A63B 57/00

[52] U.S. Cl. ..... 273/201; 273/207

[58] Field of Search ..... 273/201, 202; 221/263, 221/264, 265, 192, 191, 306, 310, 197; 124/50, 49, 53

[56] References Cited

U.S. PATENT DOCUMENTS

| | | | |
|---|---|---|---|
| 995,086 | 6/1911 | Parrett | 221/310 |
| 997,150 | 7/1911 | Mosteller | 221/306 |
| 2,171,299 | 8/1939 | Beckett | 273/201 |
| 2,285,342 | 6/1942 | MacLellan . | |
| 2,675,237 | 4/1954 | Willcox . | |
| 3,206,067 | 9/1965 | Smith, Jr. | 221/310 |
| 3,584,614 | 6/1971 | Horvath | 124/50 |
| 3,599,983 | 8/1971 | Melton | 273/201 |
| 3,738,662 | 6/1973 | Hodgin . | |
| 3,756,606 | 9/1973 | Land | 273/201 |
| 4,141,558 | 2/1979 | Hoffman . | |
| 4,146,232 | 3/1979 | Stone . | |
| 4,253,668 | 3/1981 | Ose . | |
| 4,298,142 | 11/1981 | Stanley | 221/310 |
| 4,360,204 | 11/1982 | Karr . | |
| 4,391,446 | 7/1983 | Eberle . | |
| 4,575,092 | 3/1986 | Watson . | |
| 4,676,397 | 6/1987 | Hoffmeister . | |

*Primary Examiner*—Edward M. Coven
*Assistant Examiner*—Dean Small
*Attorney, Agent, or Firm*—Leonard Tachner

[57] ABSTRACT

A gravity activated golf ball storage, dispensing and teeing apparatus comprises a cylinder for storing a plurality of golf balls, an articulated arm rotatable about a horizontal axis for delivering a golf ball onto a tee and an open wall tube which delivers the golf balls in an aligned serial array from the cylinder to the arm. The arm is weighted to be stabilized in a substantially vertical orientation until the golfer pulls the arm toward the tee and into a substantially horizontal position. An aperature, slightly smaller than a golf ball, in the open wall tube, prevents more than one ball from being dispensed onto the tee during each rotation of the arm. A preferred embodiment provides a golf ball storage container having spring-biased ball retention flaps to hold a predetermined number of balls until the container is attached to the cylinder and releases the balls.

7 Claims, 6 Drawing Sheets

GOLF BALL STORAGE, DISPENSING AND TEEING APPARATUS

BACKGROUND OF THE INVENTION

1. Field of the Invention

The present invention relates generally to an apparatus for teeing golf balls and more particularly to an apparatus for storing, dispensing and teeing golf balls without requiring the golfer to bend over or alter his stance each time a golf ball is to be placed on a tee.

2. Prior Art

The concept of providing an apparatus for storing, dispensing and teeing a golf ball is old in the art. There are numerous prior patents which disclose such devices including the following:

U.S. Pat. No. 2,285,342 to MacLellan
U.S. Pat. No. 2,675,237 to Willcox
U.S. Pat. No. 3,738,662 to Hodgin
U.S. Pat. No. 4,141,558 to Hoffman
U.S. Pat. No. 4,146,232 to Stone
U.S. Pat. No. 4,253,668 to Ose
U.S. Pat. No. 4,360,204 to Karr
U.S. Pat. No. 4,391,446 to Eberle
U.S. Pat. No. 4,575,092 to Watson
U.S. Pat. No. 4,676,397 to Hoffmeister U.S. Pat. No. 4,391,446 to Eberle is directed to a golf ball dispenser having a trough pivotally mounted for dispensing golf balls to the golf ball tee. A feed tube receives balls through cup portion from a hopper. The feed tube is in the form of an open upper-sided trough having a closed rear end. A dispensing aperture provided at the end of the trough is coupled to a dispensing head which provides the release mechanism for a ball to be placed on a tee. The trough swings about a vertical axis. Further, the reference system requires the golfer to swing the feed tube into position and then operate the dispensing head.

U.S. Pat. No. 4,253,668 to Ose is directed to a cylindrical golf ball pick-up device and dispenser. The pick-up cylinder provides the hopper for storage of balls to be dispensed. The cylinder includes a folding leg which provides an angle of inclination with respect to the ground to dispose the balls toward a charging end. From the cylinder, the balls roll to a receiving hole from which they may be ejected by a ball pushing member operated by a push down member. When the balls are pushed out of the receiving hole, they follow a conduit to the cup-shaped tee integrally connected to the conduit.

U.S. Pat. No. 4,146,232 to Stone is directed to an automatic golf ball teeing apparatus wherein golf balls are diverted to a golf ball tee by a ball conveying arm which is pivotally mounted relative to the ball hopper. The movable arm receives balls from a conduit for delivery to a tee, one at a time. The outer end of the conduit includes an opening for delivery of the golf ball to the tee, while the other end includes an opening through which a ball is received from the conduit. The operation of the pivoted arm is initiated by electrical contacts which are operated by the ball being driven from the tee, thus replacing the driven ball with a new ball.

U.S. Pat. No. 3,738,662 to Hodgin is directed to an automatic golf ball teeing device wherein a golf ball is delivered to a tee by a rotatable member, rotatable about a horizontal axis. The rotatable transfer arm includes a counterweight on one end and a ball receiving cup on the opposing end. Thus, when the transfer arm receives a ball into ball receiving cup, the transfer arm rotates to dispense the ball to the tee, subsequently returning it to the upright position.

U.S. Pat. No. 2,675,237 to Willcox is directed to a golf ball dispensing apparatus wherein a rotatable trough arm delivers balls to a tee. The trough arm includes a hole through which the tee will pass, thus permitting the trough to deliver the ball to the tee, which will be located within the aperture when the arm is in the dispensing position. The dispensing arm is electrically operated by a switch located in the golf ball tee assembly.

U.S. Pat. No. 4,360,204 to Karr is directed to a golf ball storage and feeder device which, although an electrical drive and employs a gravity feed and horizontal axis arm.

Unfortunately all of the aforementioned prior art suffers from one ore more disadvantages. By way of example, some of the prior art teeing devices require the use of electrical components which increase the complexity and cost. Other such devices, although requiring only mechanical components, are so complex in their ball control mechanisms and overall structure as to be commercially infeasible. None of the prior art known to the applicant provides for a storage container having the capacity for storing a fixed number of golf balls and adapted to fit onto the dispenser apparatus directly without any transfer of balls from one container to another. The most relevant prior art appears to be U.S. Pat. No. 4,141,558 to Hoffman. While the Hoffman apparatus does not suffer the disadvantage of the complexity of the majority of the remaining prior art, this prior art device requires that the golfer perform two separate mechanical maneuvers to dispense the ball onto the tee. More specifically, the Hoffman apparatus requires the golfer to pull a delivery arm into alignment with the tee and then depress a lever to release the ball. This requirement for performing two distinct operations to tee up a ball increases the time and inconvenience of the device thereby conflicting with its intended advantage which is to save time and reduce the number of steps required to place the ball on the tee. Furthermore, the Hoffman apparatus does not provide any form of storage device for holding a predetermined number of balls and for placing such a device onto the apparatus, but would instead require the transfer of balls from any form of storage into a hopper positioned on the apparatus.

SUMMARY OF THE INVENTION

The present invention comprises a gravity activated storage, dispensing and golf ball teeing apparatus which overcomes the noted deficiencies of the prior art. The invention is preferably made of a durable material such as polyvinyl chloride or other plastic which can readily stand extended outdoor exposure. The invention utilizes no electrical components but only simple mechanical parts that are easily assembled and are of low cost. Operation of the invention can be effected by a single motion in which the golfer utilizes the head of his golf club to swing down a mechanical arm over a tee thereby releasing the ball in its proper position teed up for the golfer's swing.

Two embodiments of the invention are disclosed herein. Each such embodiment is substantially identical to the other with the exception of the ball storage portion thereof. In one such embodiment a hopper, similar to that shown in the Hoffman patent is utilized to hold a plurality of balls for the dispensing and teeing one at a time in response to the aforementioned arm-swinging motion effected by the golfer. In a preferred embodiment however, the hopper is replaced by a storage tube which is designed to hold a preselected quantity of golf balls and which is provided with a pair of spring-loaded flaps which prevent the golf balls from exiting the storage tube until the tube is place on the cylinder portion of the present invention at which time the flaps are folded, allowing the golf balls to be dispensed by the invention in the manner to be described hereinafter. These golf balls storage tubes make the invention even more commercially desirable, particularly for driving ranges and other practice facilities for golfers because the storage tubes may be used to store the balls in a horizontal configuration such as in a bin where they may be removed while within the storage tube and placed directly on the invention without requiring any intermediate transfer between the storage bin and the dispenser of the present invention. Thus the storage tube portion of the present invention in its preferred embodiment, provides even greater convenience to the golfer as well as added convenience to the golf practice facility for dispensing a preselected quantity of golf balls at a practice or driving range and the like.

Irrespective of whether the hopper or storage tube configurations of the present invention are utilized, the basic invention comprises an articulated tubular arm designed for swinging motion about a horizontal axis. The axis is substantially aligned with a fixed tube having a cutout for receiving the balls and a swinging tube, also having a cutout for receiving the balls. The fixed and swinging tubes are coaxially positioned within a vertical cylinder to which the hopper or storage tube is attached for channeling the golf balls into the cutout portions of the fixed and swinging tubes. The swinging tube is at a slightly different angle relative to the horizontal axis of the fixed tube, thereby permitting gravity to channel the flow of balls toward the articulated arm. A ball trap aperture is provided adjacent the articulated arm to prevent more than one ball at a time from being dispensed from the arm onto the tee. The arm is weighted at its end opposite the dispensing aperture to automatically reset the arm after it dispenses the ball onto the tee and is released. As a result, the golfer need only pull the articulated arm down toward the tee in order to dispense and tee up a golf ball and this unitary motion may be readily effected without requiring the golfer to alter his stance so that he may repeatidly and rapidly swing at and hit a series of properly teed golf balls with a maximum of convenience and a minimum of time delay.

OBJECTS OF THE INVENTION

It is therefore a principal object of the present invention to provide an improved apparatus for storing, dispensing and teeing golf balls such as for practice driving ranges and the like providing a golfer with a convenient and rapid ball teeing capability without requiring bending or altering the golfer's stance to tee each ball.

It is an additional of the present invention to provide a golfer initiated ball dispenser and teeing apparatus which may be advantageously used at golf practice facilities such as driving ranges and wherein such improved apparatus is of simple low cost structure requiring only a unitary motion of an articulated arm affected by hooking the golf club head around a portion of the arm for dispensing and teeing the golf ball.

It is still an additional object of the present invention to provide an automatic golf ball teeing apparatus which in one preferred embodiment utilizes a storage tube which provides a convenient means for storing a preselected quantity of golf balls which may be readily removed from a storage facility and placed directly onto the dispenser of the present invention with a minimum of time delay and inconvenience and without requiring that the golfer pour the balls into any form of receptical separate from such storage tube.

It is still an additional object of the present invention to provide an improved storage dispensing and teeing apparatus for golf balls which requires no electrical components and no complex mechanical components thereby providing a low cost convenient apparatus of simple structure and which permits actuation by the golfer with a uniform unitary motion for rapid and convenient dispensing of the golf balls without requiring the golfer to bend or alter his stance.

BRIEF DESCRIPTION OF THE DRAWINGS

The aforementioned objects and advantages of the present invention as well as additional objects and advantages thereof will be more fully understood hereinafter as a result of a detailed description of preferred embodiments taken in conjunction with the accompanying drawings in which.

DETAILED DESCRIPTION OF PREFERRED EMBODIMENTS

Figure 1:
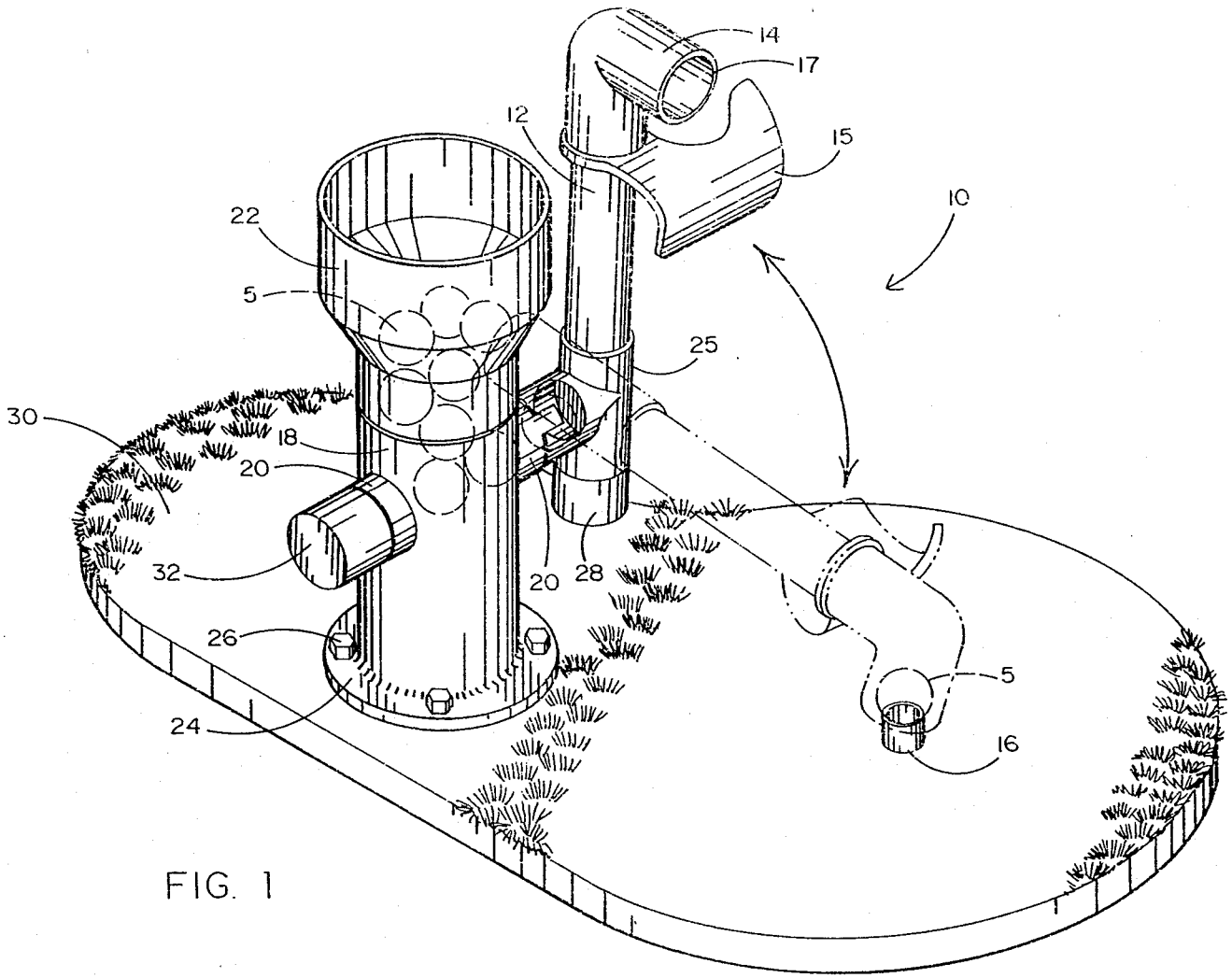
FIG. 1 is an isometric illustration of a first embodiment of the invention shown fully assembled and indicating in phantom the manner in which the articulated arm thereof may be operated.

Referring now to FIGS. 1 to 5 it will be seen that the dispensing apparatus 10 of the present invention comprises an articulated arm 12 which terminates in a right angle tube 14 having an exit aperture 17. Articulated arm 12 is designed to rotate through an angle of approximately 90 degrees from its substantially vertical position shown in solid lines in FIG. 1 to its substantially horizontal position shown in phantom lines in FIG. 1 so that the exit aperture 17 is aligned with a tee 16 for placement of a golf ball 5 thereon. A hook 15 is provided on articulated arm 12 and extends therefrom toward the tee 16 when the arm is in its substantially vertical position to provide the golfer with a covenient means for pulling the arm 12 into its horizontal position with the head of his golf club without requiring the golfer to change or alter his stance after completing his swing.

A plurality of golf balls 5 are retained within a cylinder 18 to which arm 12 is connected for relative rotation by means of a fixed tube 20 and a swinging tube 34 in a manner to be described hereinafter in more detail. In the particular embodiment shown in FIG. 1, a hopper 22 is connected to the top of cylinder 18 for increasing the ball storage capacity thereof. The bottom portion of cylinder 18 is provided with a flange 24 which is connected by a plurality of bolts 26 to an underlying stable platform such as mat 30. Articulated arm 12 is provided at the end opposite right angle tube 14 with a weight 28 which stabilizes the arm 12 in a substantially vertical position when not being pulled by the golfer into its ball dispensing horizontal position. Articulated arm 12 is provided with a tee tube 25.

Figure 2:
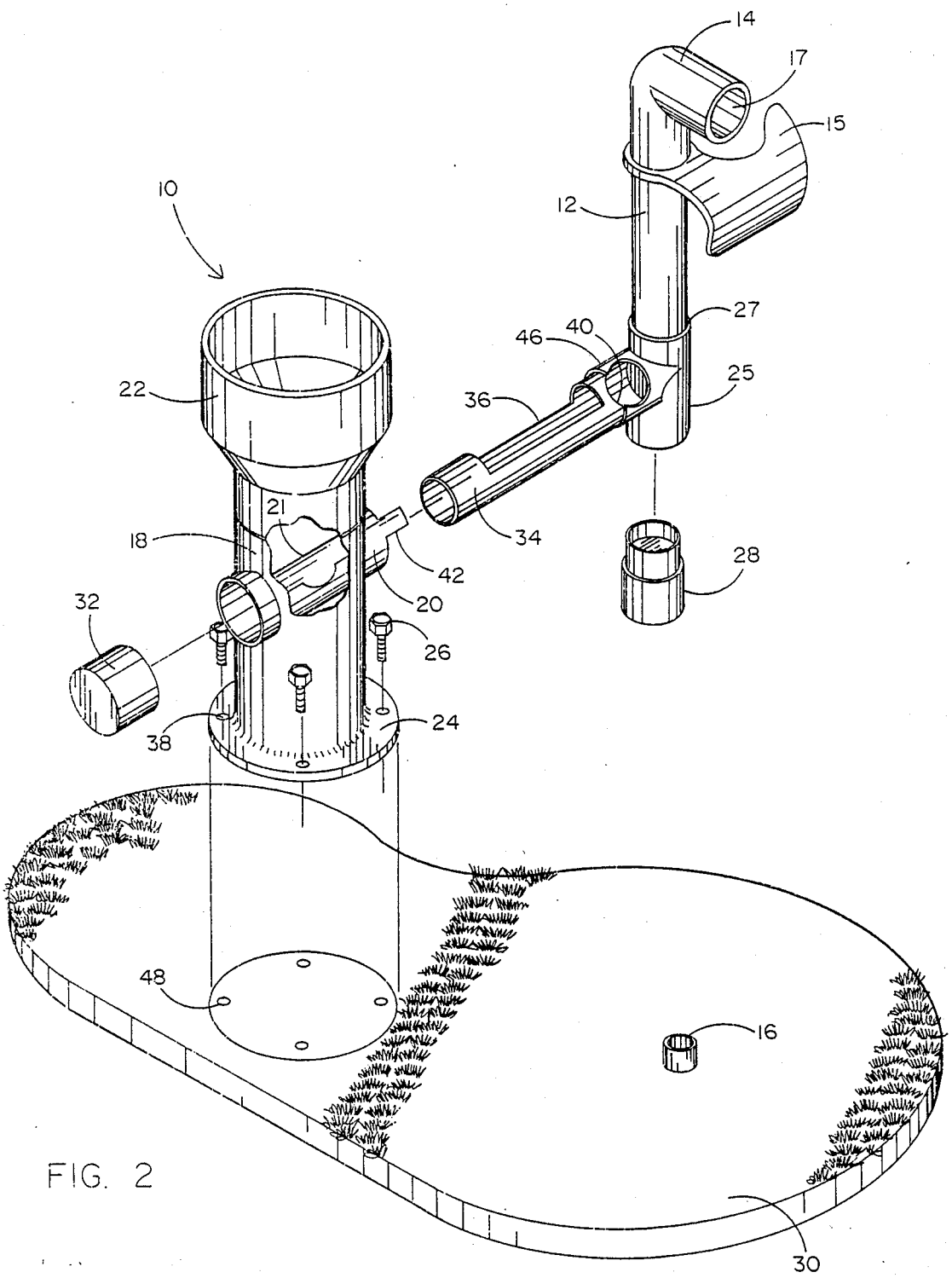
FIG. 2 is an exploded view of the embodiment of the invention illustrated in FIG. 1.

Referring to FIG. 2 it will be seen that the tee tube 25 of arm 12 is provided with a vertical portion 27 which extends over arm 12 and a horizontal portion 46, the latter being configured in coaxial overlying contiguous engagement with swing tube 34. Swing tube 34 is provided with a cutout portion 36. Similarly, fixed tube 20 which extends horizontally through cylinder 18 is provided with a cutout portion 21. The length of fixed tube 20 is greater than the diameter of cylinder 18 so that the non-cutout end portions of fixed tube 20 extend beyond cylinder 18. The fixed tube 20 is glued or otherwise affixed to the cylinder 18 so that it cannot be moved or rotated therein and so that the cutout portion 21 thereof faces toward the hopper 22. The cutout portion 36 of swing tube 34 is affixed to the horizontal portion 46 of tee tube 25 so that it faces in the same direction as the cutout portion 21 of fixed tube 20 when arm 12 is in its stable vertical position.

The external diameter of swing tube 34 is smaller than the internal diameter of fixed tube 20. In this manner, when the arm 12 and tube 34 are assembled into the remaining portions of the invention, swing tube 34 lies within fixed tube 20 and is free to rotate therein when arm 12 is articulated from the vertical to horizontal position. Additionally, while arm 12 is in its stable vertical position golfs balls held within the hopper 22 and cylinder 18 above tubes 34 and 20, can flow into the cutout portion 36 of swing tube 34 the inner-diameter of which is designed to receive the golf balls in a serial formation. A cap 32 is provided on the side of fixed tube 20 opposite articulated arm 12 where it is attached by being press-fit to the end of swing tube 34 after the swing tube has fully penetrated fixed tube 20.

As shown further in FIG. 2, the flange 24 of cylinder 18 is secured to the mat 30 by a plurality of bolts 26 through flange hole 38 and into holes 48 in the mat. In addition, it will be seen that there is a ball trap aperture 40 that is provided in the horizontal portion 46 of tee tube 25 and that this aperture passes through both the horizontal portion 46 and the adjacent end of swing tube 34. Furthermore, it will be seen that there is a kicker 42 which extends to about the center of aperture 40 extending from the end of fixed tube 20. The diameter of aperture 40 is selected so that a golf ball cannot pass fully through it but can still pass into its sufficiently to be held in the aperture while arm 12 is articulated into its horizontal position. Ball trap aperture 40 serves the purpose preventing more than one ball from entering the vertical portion 27 of the tee tube 25 so that only one ball will be dispensed each time the articulated arm 12 is rotated into its horizontal position over tee 16. Kicker 42 is provided immediately adjacent the aperture 40 on the exterior side thereof to prevent a ball from being retained within the aperture 40 after the articulated arm 12 is released and allowed to return to its substantially vertical stable position.

While the configuration of the invention illustrated in FIGS. 1–5 provide highly advantageous and convenient dispensing of golf balls in the manner described, preferred embodiment of the invention substitutes a golf ball storage tube 50 shown in FIGS. 6–10 for the hopper 22 of FIGS. 1–5. As seen best in FIGS. 6, 7 and 8, the golf ball storage tube 50 comprises a main tube 52 having a handle end 54 with a handle 56 and a dispenser end 58 formed adjacent a tapered portion 59. A pair of slots 60 are provided adjacent the dispenser end of tube 50 and a pair of ball retention flaps 62 are provided as seen best in FIG. 8. Each such ball retention flap is provided with a pair of flap levers 68 extending through the slots 60 in the side of tube 50. A spring member 64, which is connected to the side wall of tube 50 by a pair of rivets 66, applies a spring force to the flap lever 68 so that the normal position of ball retention flaps 62 is that shown in solid line in FIG. 8 wherein golf balls within the golf ball storage tube are retained therein by the retention flaps. However, when the golf ball storage tube is placed on cylinder 18 as a substitute for hopper 22, the top wall of cylinder 18 pushes the ball retention flap 62 into the vertical position shown in phantom line in FIG. 8. In this vertical position, the flap levers 68 extend out further from the wall of golf ball storage tube 50 thereby pushing the free end of flap lever 68 away from the tube where it exerts a greater spring force against the flap levers.

Figure 9:
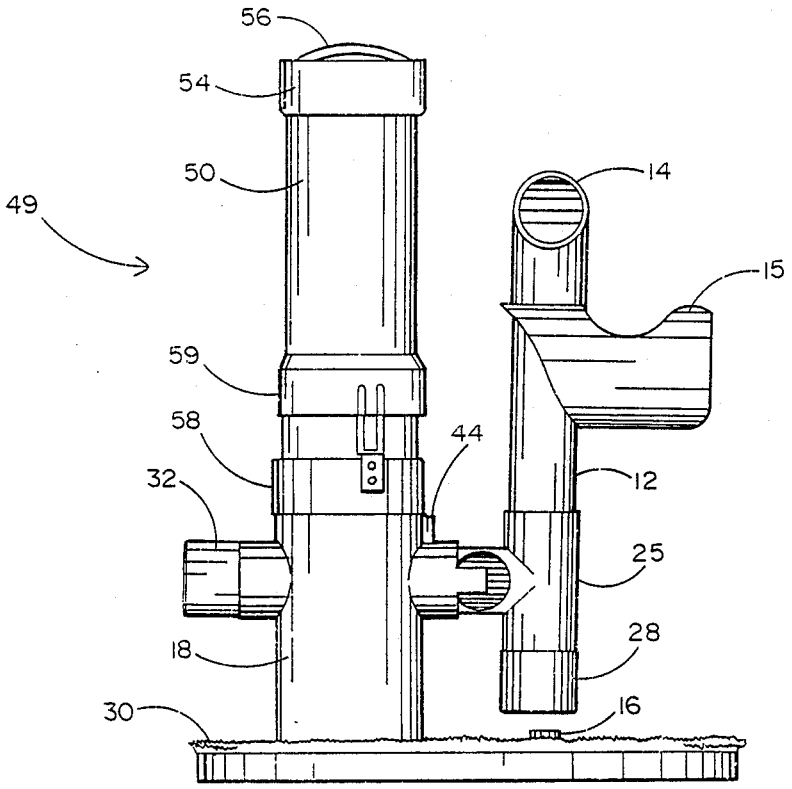
FIG. 9 is a front plan view of the second embodiment of the present invention.
Figure 10:
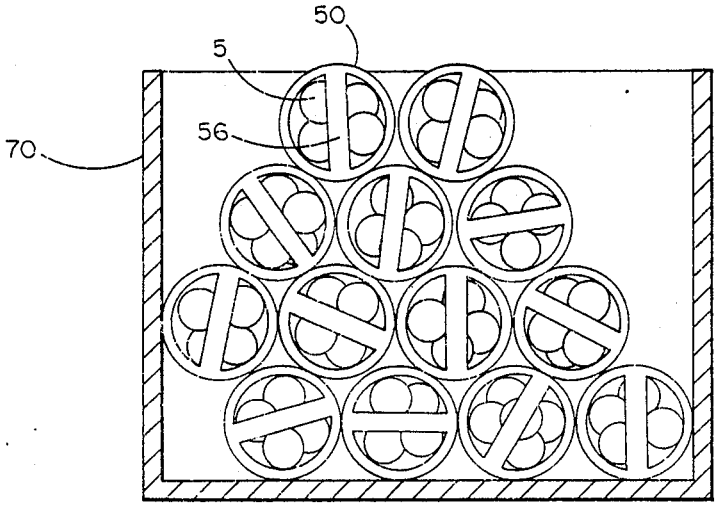
FIG. 10 is cross-sectional view of a storage bin in which a plurality of the golf ball storage tubes of the second embodiment of the invention may be stored.

Each time the golf ball dispenser tube is removed from the cylinder 18 such as after the golfer has completed dispensing of all of the golf balls within the tube, the spring force placed by spring member 64 against flap lever 68 automatically returns the ball retention flaps 62 to their horizontal ball retention configuration. Thus the second embodiment of the invention, namely, the embodiment identified by reference numeral 49 in FIG. 9, comprises all of the same elements described in conjunction with FIGS. 1–5 except that the hopper 22 has been removed and the golf ball storage tube 50 has been placed on cylinder 18 instead of the hopper. One of the substantial benefits of using golf ball storage tube 50 is that, by virtue of the ball retention flap 62 and handle 56, these storage tubes may be placed in a horizontal position such as shown in FIG. 10 within a storage bin 70. Each such storage tube may be filled with a selected quantity of golf balls 5 and made readily available for a golfer to remove same from bin 70. By simply placing one of the tubes 50 filled with balls 5 onto the cylinder 18 of the present invention, a selected number of golf balls is made ready for dispensing through the present apparatus in the manner previously described.

In either configuration, that is, using either the hopper 22 or the golf ball storage tube 50, the operation of the present invention is identical. More specifically, the plurality of golf balls 5 is held within the cylinder 18 and the attached hopper 22 or tube 50 above the fixed tube 20 and the swing tube 34. The lower-most balls fall into the cutout 36 of swing tube 34 through the cutout 21 of fixed tube 20 and align themselves automatically in a serial configurating along the interior surface of swing tube 34. As seen in FIG. 4, swing tube 34 has an outer diameter which is sufficiently smaller than the inner diameter of fixed tube 20 so that the normal rest angle between the axis of the swing tube 34 in the horizontal (assuming that the mat 30 is place on relatively level ground) is non-zero. Consequently, the balls 5 will have a tendency to roll toward the articulated arm 12 in a serial configuration until one ball is positioned within the articulated arm and the immediately adjacent ball is positioned in relative alignment with the ball trap aperture 40. When the articulated arm 12 is rotated by the golfer by means of hook 15 and the golfer's golf club until the arm 12 is in the position shown in phantom in FIG. 1, the ball within the articulated arm will, of course, roll as a result of the force of gravity toward right angle tube 14 and exit through aperture 17 onto the tee 16 in perfect position for being hit by the golfer. During this rotation of articulated arm 12, the ball immediately adjacent the one that exits arm 12, falls partially into aperture 40 where it is trapped by the aperture and blocks all of the remaining balls within cutout 36 of swing tube 34 so that only one ball at a time can be dispensed by the present invention. The golf ball trapped within aperture 40 bypasses kicker 42 as the arm is rotated more fully toward its substantially horizontal position. However, upon release of the arm, wherein weight 28 stabilizes arm 28 in a substantially vertical position as shown in the side view of FIG. 3, the kicker 42 pushes the trapped ball back fully into the swing tube 34 so that that ball is free to roll into the articulated arm 12 without being inadvertantly held within the aperture 40 by the weight of the balls behind the leading ball.

Figure 3:
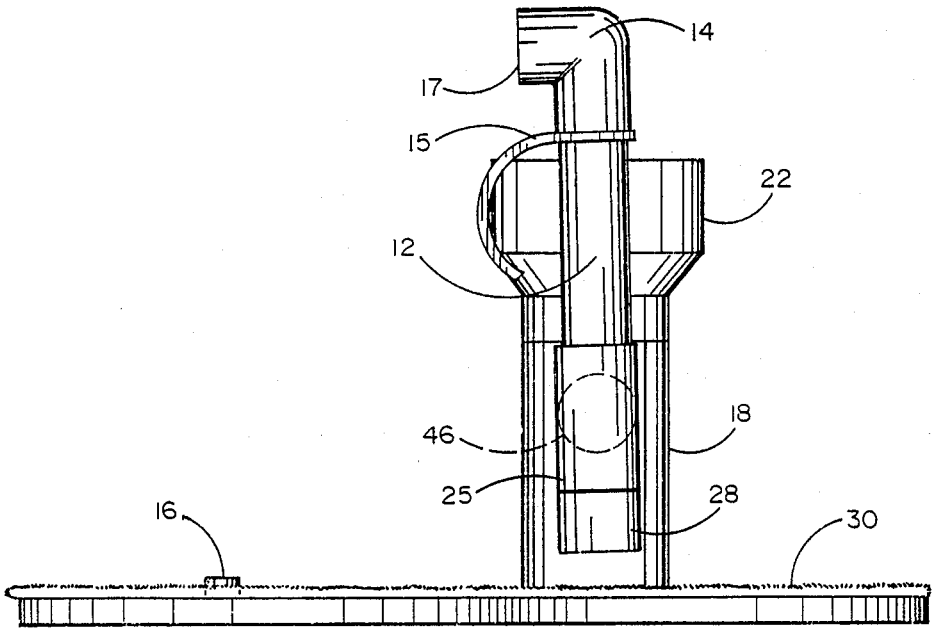
FIG. 3 is a side plan view of the embodiment of FIG. 1.
Figure 4:
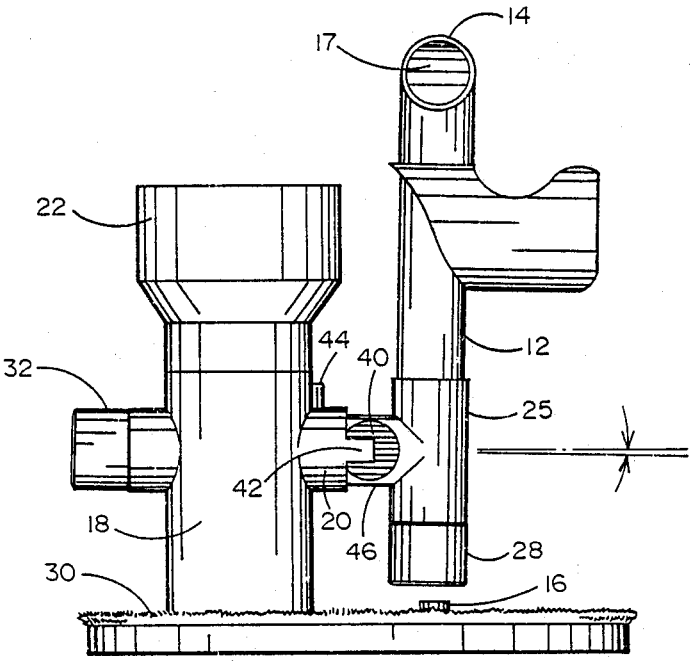
FIG. 4 is a front plan view of the embodiment of FIG. 1.
Figure 5:
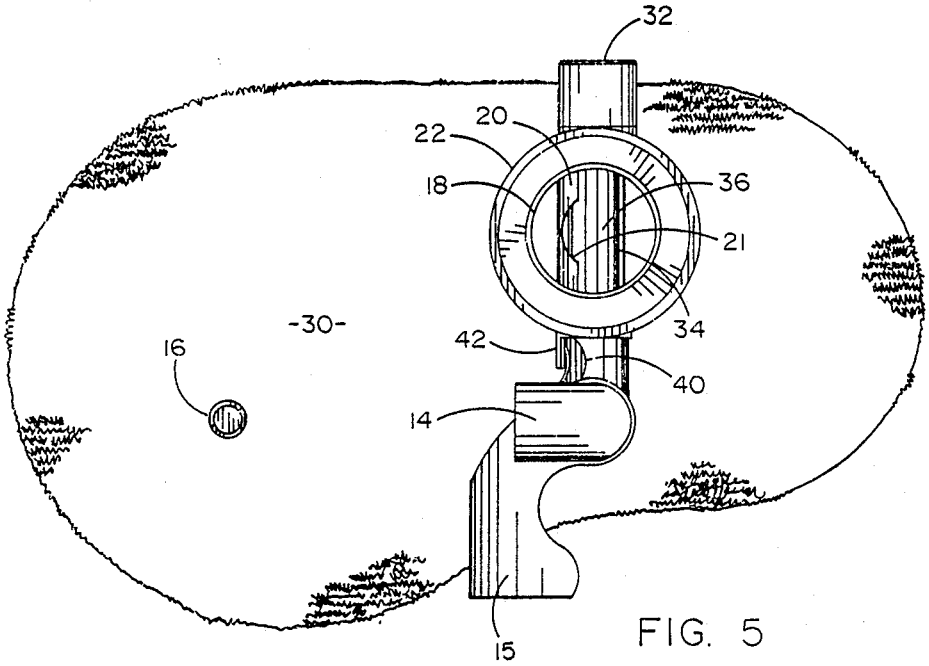
FIG. 5 is a top plan view of the embodiment FIG. 1.
Figure 8:
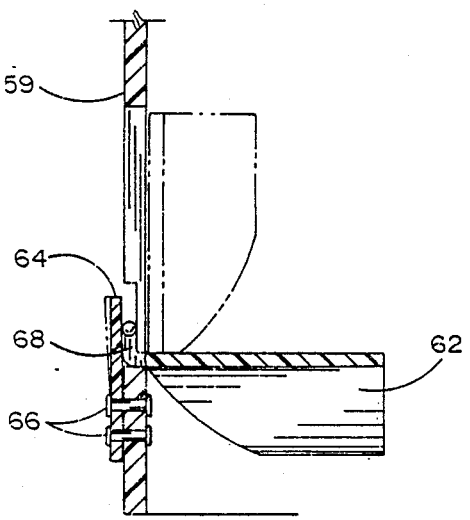
FIG. 8 is a cross-sectional view taken along lines 8—8 of FIG. 6.
Figure 6:
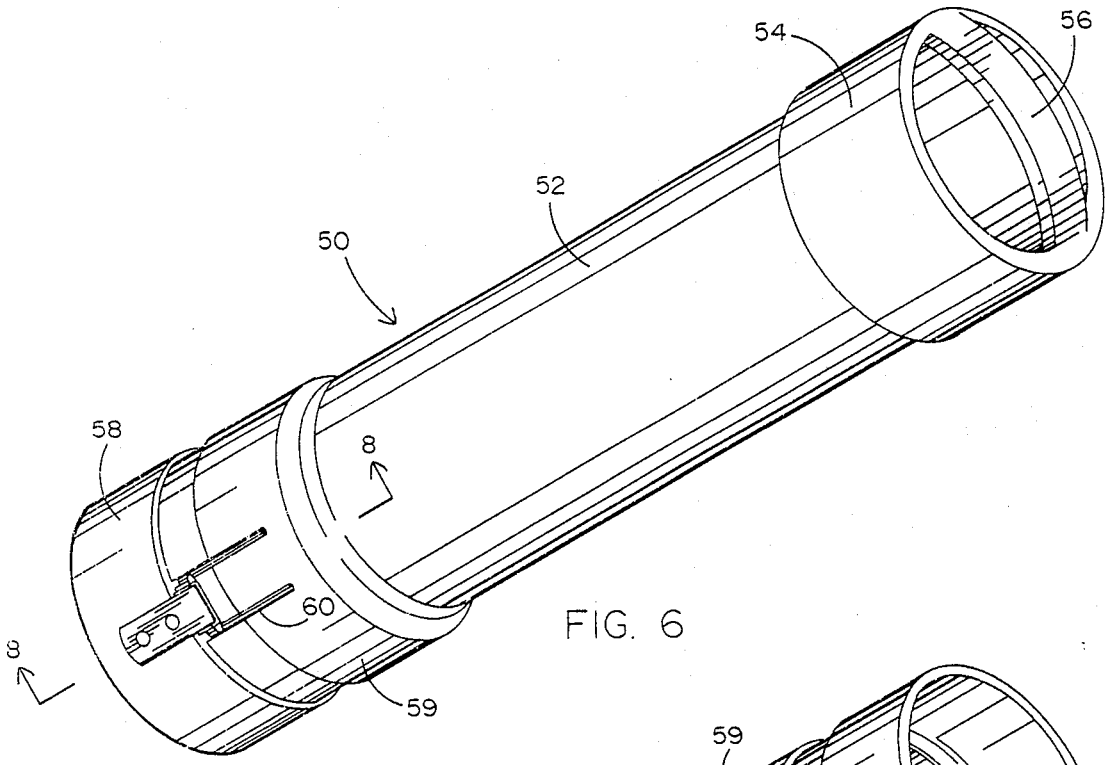
FIGS. 6 and 7 are front and rear isometric views, respectively, of a golf ball storage tube which may be used in a second embodiment of the present invention.
Figure 7:
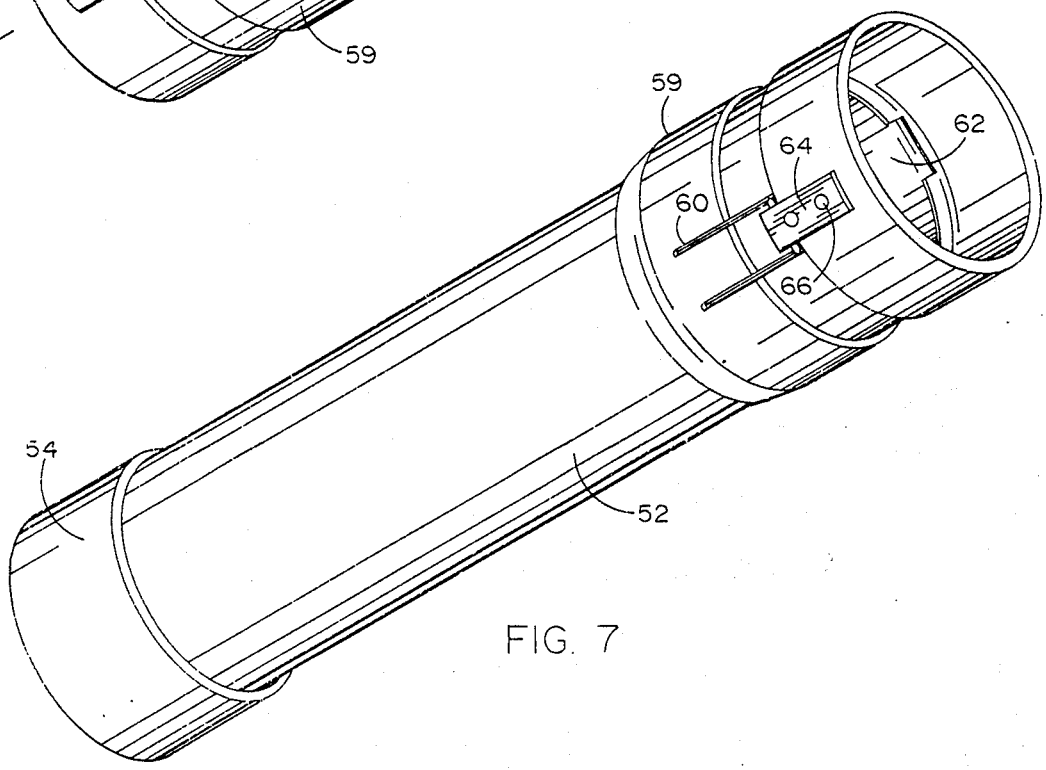

The axis of articulated arm 12, which may be seen best in FIG. 3, is slightly higher above the mat 30 than is the distance between the aperture 17 and mat 30 when the articulated arm is pulled as far as it will go toward the tee 16. As a result, when the arm has been pulled into this dispensing configuration, the articulated arm 12 is actually angled downwardly below the horizontal thereby causing golf balls to roll toward the aperture 17 to be dispensed onto the tee 16.

In FIG. 4 it will be noted that there is a peg 44 extending from the side of cylinder 18 substantially parallel and immediately adjacent to the fixed tube 20 where it extends beyond the cylinder toward the articulated arm 12. The purpose of peg 44 is to provide a stop for the golf ball storage tube 50 so that when the second embodiment of the invention shown in FIG. 9 is utilized, the dispenser end of tube 50 cannot be pushed down below the peg 44 where flaps 62 might otherwise contact the shoulder on cylinder 18 and damage flaps 62 of golf ball storage tube 50.

It will now be understood that what has been disclosed herein comprises a unique golf ball storage, dispensing and teeing apparatus which finds particularly advantageous application for use in a golf practice facility such as a driving range where a golfer may wish to practice his swing and hitting the ball using a series of teed golf balls. The present invention makes it possible to tee up a large number of golf balls consecutively in a convenient manner by simply using the golf club to pull on a hook attached to an articulated arm which releases a golf ball onto a tee in a position ready to be hit by the golfer's club. This may be accomplished in one simple motion without requiring the golfer to change his stance and without requiring him to bend over, both of which motions would otherwise detrimentally affect the golfer's consistency and lead to fatigue. The advantageous features of the present invention are provided in an apparatus which obviates any requirement for electrical components and which provides a simple structure which may be manufactured at relatively low cost. Two alternative embodiments have been disclosed. One uses a hopper to store the golf balls as they are being dispensed and another utilizes a golf ball storage tube, the latter having the added advantage of providing a convenient means for storing the golf balls in a central facility such as a large storage bin and allowing a transfer of the balls to the apparatus of the present invention by simply installing the storage tube directly onto the apparatus without requiring any pouring of the balls or any otherwise inconvenient and time consuming steps.

Those having skill in the art to which the present invention pertains will, as a result of the applicant's teaching herein, now perceive various modifications and additions which may be made to the invention. By way of example, the specific dimensions and materials may be readily modified as well as the particular mechanical components, interfaces, and structures in order to further reduce manufacturing cost. Accordingly all such modifications and additions are deemed to be within the scope of the invention in which is to be limited only by the claims appended hereto.

I claim:

1. A gravity activated golf ball teeing apparatus comprising:

a cylinder for storing a plurality of golf balls, said cylinder having a pair of opposed coaxial apertures defining an axis which is substantially perpendicular to the axis of said cylinder;

a fixed tube extending through said apertures, said fixed tube having a cutout portion within said cylinder;

a swing tube lying substantially coaxially within said fixed tube and also having a cutout portion, the interior diameter of said swing tube being properly dimensioned for receiving a plurality of serially arrayed golf balls, the outer diameter of said swing tube being smaller than the inner diameter of said fixed tube to permit rotation of said swing tube within said fixed tube and to permit the axes of said fixed tube and swing tube respectively to define a non-zero angle to promote the gravitational flow of said serially arrayed golf balls toward one end of said swing tube;

an articulated tubular arm affixed perpendicularly to said one end of said swing tube exterior of said cylinder, said tubular arm providing a path for said serially arrayed golf balls within said swing tube and an exit aperture at one end thereof spaced from said one end of said swing tube and through which exit aperture said golf balls may be selectively delivered onto a tee, said arm also having a weight positioned at the end thereof opposite said exit aperture end, said swing tube being affixed to said tubular arm intermediate of said exit aperture end and said weight end of said tubular arm whereby said tubular arm is normally in a substantially vertical position and releases a golf ball through said exit aperture onto said tee when said exit aperture end of said tubular arm is rotated into a position below horizontal.

2. The apparatus recited in claim 1 further comprising means for preventing more than one of said serially arrayed golf balls from being dispensed through said exit aperture end at any one time.

3. The apparatus recited in claim 2 wherein said preventing means comprises an aperture in said swing tube exterior of said cylinder and immediately adjacent said tubular arm, said swing tube aperture being smaller than the diameter of a golf ball and being positioned to face downwardly when said arm is rotated into a ball dispensing position whereby a ball trapped in a nesting position in said swing tube aperture prevents more than one of said serially arrayed balls from entering said tubular arm during each rotation of said tubular arm.

4. The apparatus recited in claim 1 further comprising golf ball storage means attached to said cylinder for increasing the ball handling capacity of said apparatus.

5. The apparatus recited in claim 4 wherein said golf ball storage means comprises an open hopper.

6. The apparatus recited in claim 4 wherein said golf ball storage means comprises a tubular member having means for retaining a selected quantity of said golf balls until said tubular means is placed onto said cylinder releasing the golf balls therein into said cylinder.

7. The apparatus recited in claim 6 wherein said retaining means comprises at least one spring-biased member having a first position for retaining golf balls within said tubular member and a second position for releasing golf balls from said tubular member, said spring-biased member being moved from said first position to said second position when said tubular member is placed onto said cylinder.

* * * * *